United States Patent [19]

Brill

[11] Patent Number: 5,060,952

[45] Date of Patent: Oct. 29, 1991

[54] SELF CONTAINED PUTTING AID

[76] Inventor: Edward F. Brill, 999 E. Summit Ave., Oconomowoc, Wis. 53066

[21] Appl. No.: 643,341

[22] Filed: Jan. 22, 1991

[51] Int. Cl.[5] ..... A63B 69/36

[52] U.S. Cl. ..... 273/186 C; 273/192; 273/177 R

[58] Field of Search ..... 273/191 R, 192, 191 A, 273/191 B, 187 R, 183 A, 186 R, 186 C, 186 B, 177 R

[56] References Cited

U.S. PATENT DOCUMENTS 2,754,125 7/1956 Engler ..... 273/192

4,423,875 1/1984 Miller ..... 273/192

*Primary Examiner*—George J. Marlo

*Attorney, Agent, or Firm*—Andrus, Sceales, Starke & Sawall

[57] ABSTRACT

A self contained putting aid, including an elongated rail having a generally U-shaped cross section. An elongated, flexible aiming strip is connected to the rail through a parallelogram linkage so that the strip can be moved from an operative position, where it is in spaced, parallel relation to the rail, to an inoperative position, where it is located within the rail. An end of the strip is formed with a hole to support a golf ball, and a movable backstroke guide is mounted on the strip and serves as a guide for the length of the backstroke. A plurality of adjustable holding members project downwardly from the rail and are adapted to engage a carpet or other putting surface to prevent movement of the rail during the putting stroke.

21 Claims, 2 Drawing Sheets

SELF CONTAINED PUTTING AID

BACKGROUND OF THE INVENTION

Various types of putting aids have been employed to practice and improve the putting stroke. In some cases, the putting aids are in the form of alignment devices to properly align the feet and the ball position. Other putting aids include guides that serve to guide the putter head in the backstroke and follow through, in order to develop a controlled putting stroke.

In general, the putting aids as used in the past have been relatively large and cumbersome devices which are not easily transported or set up.

SUMMARY OF THE INVENTION

The invention is directed to a self contained putting aid that can be folded into a small, compact package for storage and transport. The putting aid includes an elongated rail having a generally U-shaped cross section, including a vertical web and a pair of parallel, horizontal legs that extend outwardly from the web. A flexible, elongated alignment strip is connected to the rail via a pair of links which provide a parallelogram type linkage that enables the strip to be moved between an operative position, where it is in spaced, parallel relation to the rail, to an inoperative or storage position, where the strip is located within the rail.

Located in one end of the alignment strip is a depression or hole which supports a golf ball, and an alignment line extends rearwardly from the ball support along alignment strip. Scaled markings can be applied in spaced relation along the length of the alignment strip to serve as a guide for the length of the backstroke, and a backstroke guide can be mounted for sliding movement on the strip and positioned at the markings to provide through peripheral vision an indication of the length of the backstroke.

To firmly hold the rail against the carpet or other putting surface, a plurality of screws are threaded in the rail and can be threaded downwardly to a position where they project beneath the rail and engage the putting surface. In their storage or non-holding position, the screws are located solely within the rail and do not protrude therefrom.

A target can also constitute a portion of the putting aid, and has an inverted V-shaped cross section. Holes are provided in opposed ends of the target, which are adapted to receive a tee or other fastener to hold the target to the putting green or other putting surface. The target includes markings which correspond in size to a golf cup.

The putting aid of the invention enables the feet of the golfer and the putter head to be properly positioned, and provides a training guide to stroke the putter online, strike the ball at the sweet spot of the putter head with the face of the putter square to the line of putt and control the speed of the ball.

The putting aid can be used either on a putting green, a carpet, or any other desired putting surface, and can be locked to the surface to prevent movement.

The putting aid is a compact, self contained unit that can be folded into a compact condition for transportation or storage. In the folded state, the aid is of a size that will readily fit within in an attache case, a suitcase or a golf bag.

The invention also includes a separate target which can be stored and locked within the rail when not in use.

Other objects and advantages will appear in the course of the following description.

DESCRIPTION OF THE DRAWINGS

The drawings illustrate the best mode presently contemplated of carrying out the invention. In the drawings.

DESCRIPTION OF THE ILLUSTRATED EMBODIMENT

The drawings illustrate an improved putting aid which can be folded into a compact package for transporting and storage.

Figure 3:
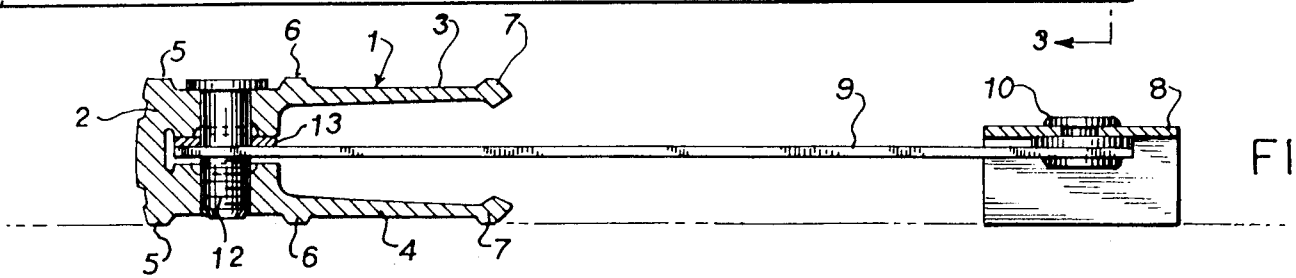
FIG. 3 is a section taken along line 3—3 of FIG. 2.
Figure 4:
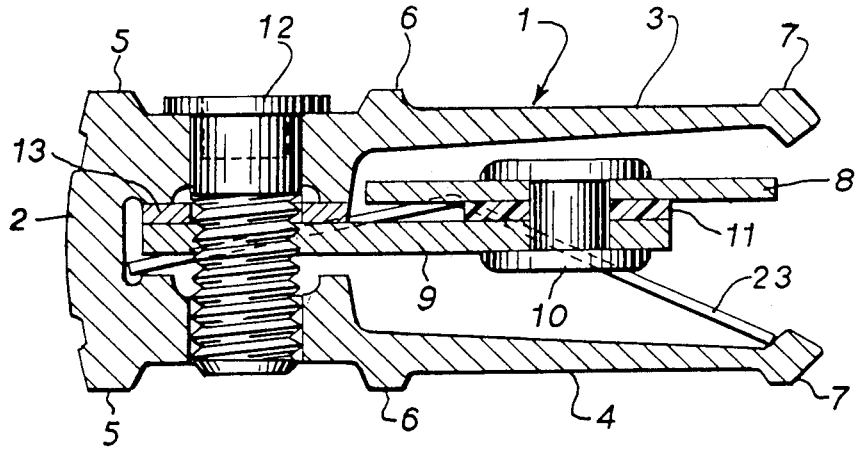
FIG. 4 is a section taken along line 4—4 of FIG. 1.
Figure 5:
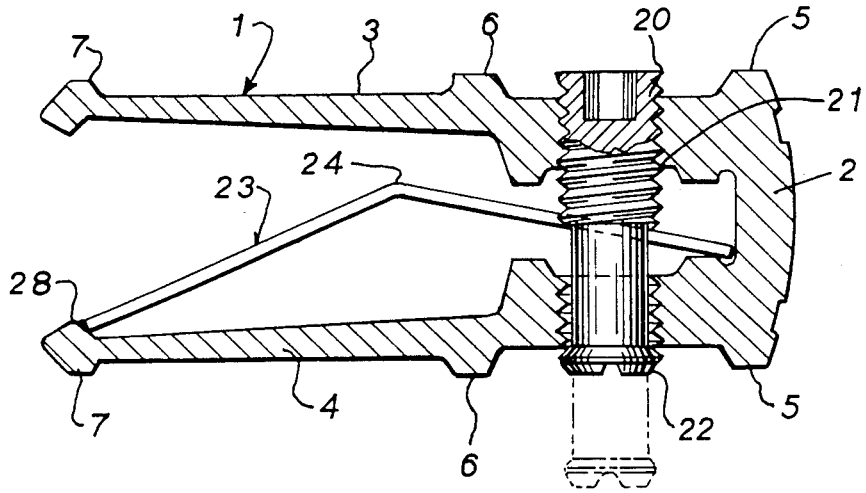
FIG. 5 is a section taken along line 5—5 of FIG. 1.

The putting aid includes an elongated rail 1, preferably formed of extruded aluminum, that is composed of a generally vertical web 2 and a pair of horizontal legs 3 and 4 which extend outwardly in spaced parallel relation from web 2 as best illustrated in FIGS. 3–5.

Each leg 3,4 is formed with a series of external projecting ribs 5,6 and 7, and in use the ribs will engage the putting surface, which can be a putting green, carpet or the like, and aid in preventing lateral movement of the rail on the putting surface. Rib 7 provides a fulcrum point about which the device is balanced.

The putting aid also includes an elongated alignment or aiming strip 8 which can be formed of a flexible material, such as stainless steel, plastic or the like. Strip 8 is connected to rail 1 through a pair of links 9 which provide a parallelogram-type linkage. As shown in FIG. 4, one end of each of link 9 is connected to strip 8 by a pivot pin or rivet 10, and a washer 11, formed of a material such as nylon, is interposed between the link and the strip at the pivot.

Figure 1:
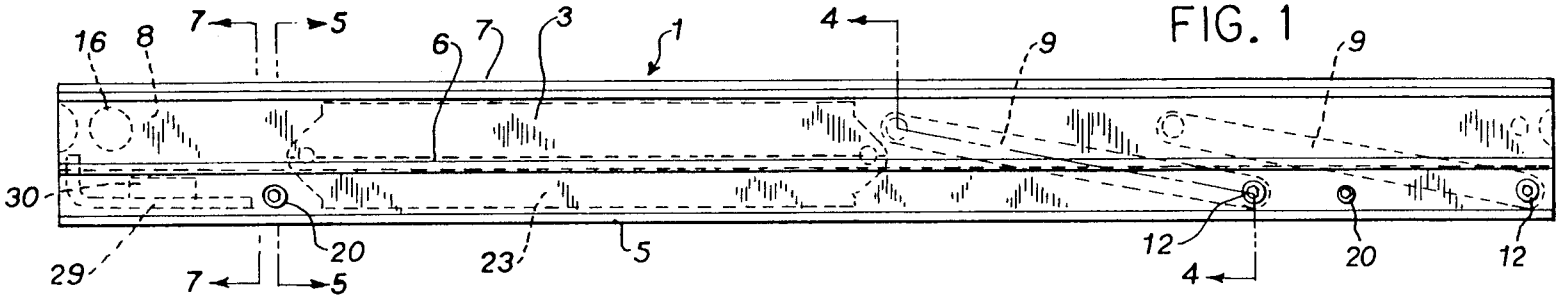
FIG. 1 is a plan view of the putting aid of the invention in the storage position with parts broken away in section.
Figure 2:
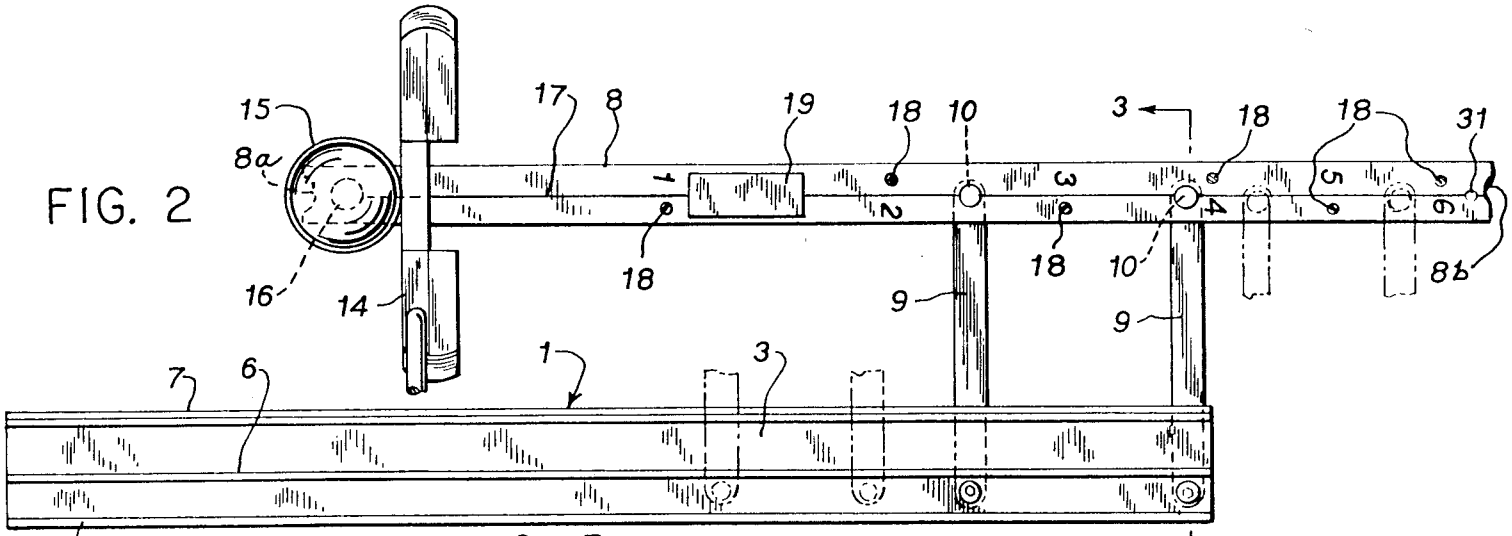
FIG. 2 is a view similar to FIG. 1 showing the alignment strip in an operative position.

The opposite end of each link 9 is pivotally connected to rail 1 by a screw 12. Screw 12 is threaded to the link 9 and a washer 13, preferably formed of metal, is located between the link 9 and the upper leg 3 of the rail. Loosening of the screw 12 permits the links 9 to pivot relative to the rail 1 so that the strip 8 can be moved between a storage position, where the link is located within the rail, as shown in FIG. 5, to an operative position, as shown in FIG. 2, where strip 8 is spaced and parallel to rail 1. Threading down the screws 12 will lock the strip 8 in the desired position.

With this arrangement, the spacing between the strip 8 and rail 1 can be adjusted as desired. The spacing is usually such that the heel of the putter head 14 will be located adjacent the inner edge of rail 1, as shown in FIG. 2. A mark or wording can be applied to upper surface of leg 3 of the rail adjacent the end of the rail, indicating the proper position of the left foot. For left handed golfers, the rail is inverted and a similar mark or wording can be applied to leg 4, adjacent the opposite end.

As seen in FIG. 4, the pivotal connection between strip 8 and rail 1 is located above the putting surface, and due to the flexibility of the strip the far or outer end of the strip will rest on the putting surface. To position a golf ball 15 on the outer end of strip 8, the strip is formed with a hole or depression 16. In addition, a notch 8*a* is formed in the end of strip 8 and can be used to position the ball rather than hole 16.

A central line or marking 17 is applied to the upper surface of strip 8 and extends from the hole 16 the entire length of the strip 8, as shown in FIG. 2. Line 17 extends along the selected line of putt and aids in maintaining the putter on-line and keeping the putter face square to the line of putt during the putting stroke.

A series of scaled markings 18 can be applied in spaced relation to strip 8 along the length of line 17. In addition, a movable guide 19 can be mounted on the upper surface of alignment strip 8, and the guide 19 serves as a visual guide for the length of the backswing during the putting stroke. As illustrated, the guide 19 takes the form of a magnetic strip which is applied to the stainless steel alignment strip 8. However, it is contemplated that the movable guide 19 can also take the form of a slide which is mechanically engaged with the side edges of the strip 8 and can be slid along the length of the strip. The markings 18, along with the movable guide 19, serve as an aid in providing the proper length of backswing to obtain acceleration on the follow through of the putting stroke.

To firmly secure rail 1 to the putting surface, a pair of holding or anchoring screws 20 are threaded to the rail 1 and can be threaded downwardly to a position beneath the leg 4, where they will engage the putting surface. As shown in FIG. 5, each screw 20 is provided with a thread 21 which is engaged with threaded holes in the legs 3 and 4. Screw 20 has a length such that when in the storage position, as shown by the full lines in FIG. 5, the ends of the screw will be within the outer extremities of the ribs 5 and 6, so that the ends of the screw will not contact or scratch a surface on which the rail is resting. By threading down the screw 20, the thread 21 will be unthreaded from the hole in leg 3 and will thread into the aligned hole in lower leg 4, as shown by the dashed lines in FIG. 5. The lower end of screw 20 is provided with a cup pointed end 22, which will engage the putting surface to hold or anchor the rail against movement. The cup pointed end 22 being enlarged, will also serve as a stop and engage the lower surface of leg 4 to locate the screw in the storage position, and may be provided with the usual slot for receiving a screw, coin, or other tool, as shown in FIG. 5.

Figure 6:
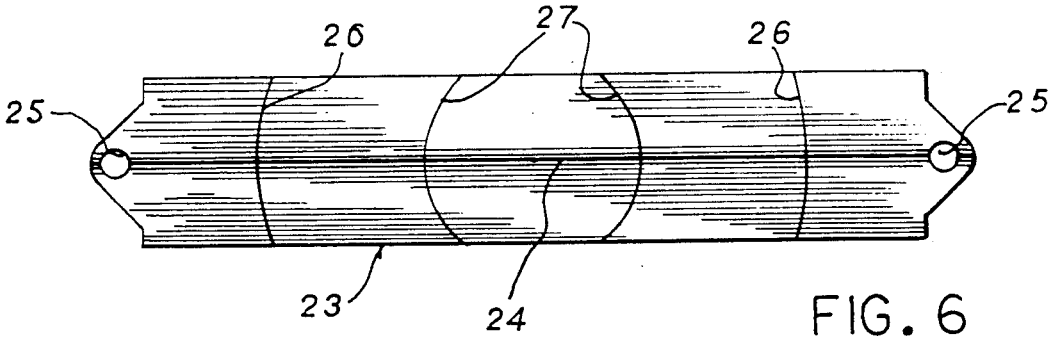
FIG. 6 is a plan view of the target.

The alignment aid of the invention also includes a target 23 which is normally positioned at a substantial distance from the alignment strip 8 and serves as a simulated golf cup. As shown in FIGS. 5 and 6, target 23 is in the form of an elongated strip and has an inverted V-shape cross section, including a central ridge 24. The V-shaped cross section will tend to lock the target 23 to the putting surface as prevent slippage. In addition, the ends of target 23 are provided with a pair of holes 25 and if the target is to be used on a putting green, tees can be inserted into the holes 25 to lock the target to the putting green. The distance between tees 25 is equal to the cup diameter plus the ball diameter. Thus, if the target 23 is secured to a putting green by tees that project through holes 25, any putted ball that passes between the tees would normally fall into the cup, if putted with proper speed.

Target 23 can be provided with a pair of curved lines or markings 26 which provide a representation of a golf cup. The distance between the lines 26 corresponds to the diameter of a golf cup. In addition, a second pair of curved lines 27 can be applied to the target 23, with the distance between the lines 27 corresponding to the diameter of a golf ball.

When target 23 is not being used, it can be stored within the rail 1, as shown in FIG. 5. One side edge of the target is engaged with web 2 of the rail, while the opposite side edge engages an abutment 28 on the end of leg 4. With this arrangement, the target can be merely snapped into place within the rail and will be retained within the rail during storage and transport.

Figure 7:
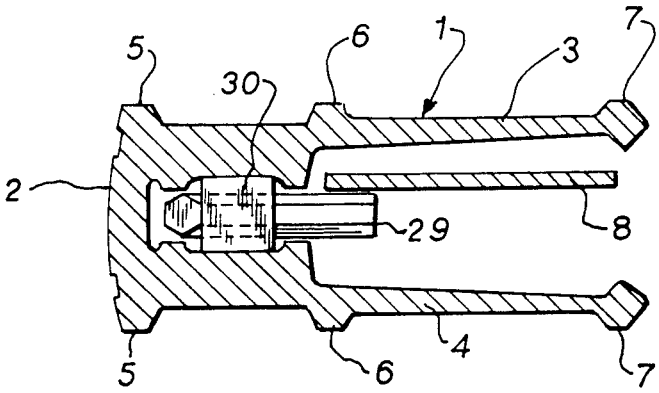
FIG. 7 is a section taken along line 7—7 of FIG. 1.

As a further feature of the invention, the tool for operating the screws 12 and 20 can also be stored within the rail 1. As shown in the drawings, screws 12 and 20 have hex-shaped recesses in one end which are adapted to be engaged by a hex wrench 29, which has a generally L-shaped configuration. As shown in FIG. 7, a magnet 30 is mounted within the side rail 1 and holds the hex wrench 29 within the side rail when not in use. Alternatively, the screws 12 and 20 can have slotted heads which can be engaged by a screwdriver, coin, or the like to provide the adjustment.

The rear end of strip 8 can also be formed with a hole 31 to receive a tee and secure the strip to the putting green or other putting surface and prevent movement of the strip due to possible impact by the putter.

The rear end of strip 8 can also be formed with notch 8*b* and the notches 8*a* and 8*b* serve as finger grips to aid in removing strip 8 from its storage position within rail 1.

While the drawings illustrate the putting aid being composed of a single rail 1, it is contemplated that the device may also include a pair of rails so that the alignment strip 8, when in the operative position, would be located in spaced relation between the two rails and the links 9 would not only be pivotally connected to rail 1 and strip 8, but would also be connected to the second rail. In this construction, the open ends of the two rails would be in abutting condition when the putting aid is moved to the storage position.

The putting aid of the invention assists in proper foot and ball alignment, as well as aiding in developing a smooth and controlled backswing and follow through.

For storage, the putting aid can be folded to a compact package and can be readily stored in a brief case, suitcase or golf bag.

The device can be used for either right or left-handed golfers. To shift from right-to-left play, or vice versa, screws 12 and 20 are removed from rail 1, the rail and strip 8 are reversed and the screws are re-inserted in the rail.

A right handed golfer may putt with his left foot slightly forward of the right foot. To permit corresponding offset of the alignment strip 8, the connection of links 9 can be offset as shown in phantom in FIG. 2. In this embodiment, the pivot screws 12 are moved forwardly in the rail 1 and the pivot screws 10 in the strip 8 are moved rearwarldy. As a result, the extension of the strip 8 to a putting position will position the strip 8 with the hole 16 located forwardly of the nail 1.

Various modes of carrying out the invention are contemplated as being within the scope of the following claims particularly pointing out and distinctly claiming the subject matter which is regarded as the invention.

I claim:

1. A self contained putting aid, comprising an elongated rail having a generally U-shaped cross section, an elongated flexible alignment strip, a pair of links pivotally connected between said strip and said rail, said links being constructed and arranged such that said strip is movable from an operative position where the strip is in spaced parallel relation to the rail to a storage position where said strip is located within the rail, and positioning means associated with a forward end of said strip for positioning a golf ball.

2. The putting aid of claim 1, and including locking means for locking said strip in the operative and storage positions.

3. The putting aid of claim 2, wherein said locking means comprises a threaded member connecting each link and said rail.

4. The putting aid of claim 3, wherein an end of said threaded member has a hex-shaped recess and said putting aid also includes a hex-shaped wrench to engage said recess, and means for removably connecting said hex wrench within said rail.

5. The putting aid of claim 4, wherein said means for removably connecting said hex wrench comprises magnetic means.

6. The putting aid of claim 1, and including a guide mounted for adjustable movement along the length of said strip to provide a visual guide for the backswing during the putting stroke.

7. The putting aid of claim 6, wherein said strip is a ferrous metal and said guide is a magnet.

8. The putting aid of claim 6, wherein said guide is slidably mounted on said strip.

9. The putting aid of claim 6, and including a series of spaced markings disposed in spaced relation along the length of said strip.

10. The putting aid of claim 1, wherein said rail includes a generally vertical web and a pair of spaced horizontal legs extending outwardly from said web, a first of said legs adapted to rest on a putting surface, and adjustable holding means projecting downwardly from said first leg to engage said surface.

11. The putting aid of claim 10, wherein said adjustable holding means comprises a holding member threadedly engaged with said first leg.

12. The putting aid of claim 11, wherein both of said legs are provided with aligned threaded openings to receive said holding member, the length of said holding member being less than the vertical thickness of the rail whereby said holding member when in a non-holding position is located within the thickness of said rail.

13. The putting aid of claim 1, and including a target separate from said strip and said rail, and means for removably securing said target within said rail when said strip is in the storage position.

14. The putting aid of claim 13, wherein said target is elongated and has an inverted V-shaped cross section.

15. The putting aid of claim 14, wherein said target has at least one hole to receive a fastener to connect the target to a putting surface.

16. The putting aid of claim 13, and including markings on said target to simulate a golf cup.

17. The putting aid of claim 1, wherein the forward end of said strip when in the operative position is located rearwardly of the forward end of said rail.

18. The putting aid of claim 17, wherein the forward end of said strip when in the storage position is located adjacent the forward end of said rail.

19. The putting aid of claim 1, wherein the forward end of said strip when in the operative position is located forwardly of the forward end of said rail.

20. a self contained putting aid, comprising an elongated metal rail having a generally U-shaped cross section and including a generally vertical web and a pair of horizontal legs extending outwardly in spaced relation from said web, a first of said legs adapted to rest on a putting surface, an elongated flexible strip, a parallelogram linkage pivotally connecting said strip to said rail and constructed and arranged such that said strip can be moved between an operative position where said strip is in spaced parallel relation to said rail and a storage position where said strip is contained within said rail, means located adjacent an end of the strip for positioning a golf ball, and adjustable anchoring means connected to said rail for engaging said putting surface to prevent shifting of said rail on said putting surface, said adjustable anchoring means being movable between a storage position where said adjustable anchoring means is located within said rail to a projecting position where said anchoring means extends downwardly beneath said rail.

21. The putting aid of claim 20, wherein said anchoring means is threadedly engaged with said rail.

* * * * *